US005921410A

United States Patent [19]

Emery et al.

[11] Patent Number: 5,921,410

[45] Date of Patent: Jul. 13, 1999

[54] PORTABLE RACK SHELF

[75] Inventors: William W. Emery, Berkeley Heights; Russell A. Fritts, Warren, both of N.J.

[73] Assignee: Better Sleep Mfg. Co., Berkeley Heights, N.J.

[21] Appl. No.: 08/904,483

[22] Filed: Jul. 31, 1997

[51] Int. Cl.[6] ..... A47F 5/08

[52] U.S. Cl. ..... 211/88.01; 211/90.03; 211/119.009; 108/42

[58] Field of Search ..... 211/86.01, 90.01, 211/90.03, 119.009, 119.011, 87.01, 106, 88.01; 108/42

[56] References Cited

U.S. PATENT DOCUMENTS

| | | | |
|---|---|---|---|
| Re. 11,610 | 6/1897 | Huebel et al. | 211/86.01 X |
| D. 354,412 | 1/1995 | Emery . | |
| D. 365,239 | 12/1995 | Emery et al. . | |
| 1,986,935 | 1/1935 | Levine | 211/86.01 X |
| 2,612,273 | 9/1952 | Smith | 211/119.009 |
| 3,096,731 | 7/1963 | Lehman . | |
| 3,730,108 | 5/1973 | Stroh . | |
| 3,915,097 | 10/1975 | Young, Jr. . | |
| 4,827,849 | 5/1989 | Vignale | 108/42 X |
| 4,846,430 | 7/1989 | Ke . | |
| 4,870,907 | 10/1989 | Mekee | 211/90.01 X |
| 5,119,945 | 6/1992 | Wiggins . | |
| 5,169,010 | 12/1992 | Fortner | 211/86.01 |
| 5,181,621 | 1/1993 | Plaehn | 211/116.011 X |
| 5,433,152 | 7/1995 | Henry | 108/42 |
| 5,460,279 | 10/1995 | Emery et al. . | |
| 5,711,434 | 1/1998 | Adams | 108/42 X |

*Primary Examiner*—Blair M. Johnson
*Attorney, Agent, or Firm*—Hopgood, Calimafde, Kalil & Judlowe, LLP

[57] ABSTRACT

The invention is directed to a multipurpose, mountable shelf which is easily collapsible for cost effective transportation. The device is assembled with ease by the end-user and is characterized by a unique, yet simple locking mechanism for stable, structural integrity.

10 Claims, 4 Drawing Sheets

PORTABLE RACK SHELF

FIELD OF INVENTION

The present invention relates to shelf organizers, and more particularly, to a portable shelf which is collapsible and transportable in kit form to be assembled by the end-user.

BACKGROUND OF THE INVENTION

Organizing devices for hanging over doors or other structures which allow similar suspension are known. For example, U.S. Pat. No. 4,846,430 discloses a door hanging organizer for suspending garments or towels. Similarly, shelf organizers can take advantage of existing fixtures by acting as adaptors to common household objects such as clothes racks and closet gateways. For example, U.S. Pat. Nos. Des. 354,412, Des. 365,239 and 5,460,279 provide multiple shelves for extra storage for placing and holding various sundry items in neat order while taking advantage of space which is otherwise unused. Other examples include shoe storage bags which have multiple tiered storage compartments and designed to suspend on a hanger pole inside a closet.

While taking advantage of existing structures and unused space is convenient for the end-user, the manufacturer also desires compact organizers for easy shipping and reduced freight rates. Single piece units are costly to transport, difficult to handle and require excessive storage and retail space. In the art, it is desirable to produce "knocked down" or collapsible versions of organizers. There is always a need in the art for organizers which have advantages that overcome the shortcomings and drawbacks of prior art designs.

OBJECTS OF THE INVENTION

It is an object of the present invention to provide a collapsible shelf with a reversible locking mechanism for superior, overall structural integrity upon assembly.

Another object of the present invention is to provide a shelf organizer which is collapsible for cost-effective shipping, storage and display.

A further object is to provide a collapsible organizer for use with a conventional towel rack which creates an extra shelf for holding items.

Yet another object is to provide a collapsible organizer for use with an existing fixture rack which creates an extra shelf for holding items.

These and other objects will be apparent from the present disclosure.

SUMMARY OF THE INVENTION

The invention is a shelf of collapsible construction for mounting to pre-existing structures such as conventional towel racks, hand-rails or the like. The mounting provides an "extra" shelf for holding items such as household sundries. The shelf is comprised of a central basket having a first keyhole, a second keyhole, a third keyhole and a fourth keyhole. The shelf also has a first bracket having a first base portion which terminates at a first leg and a second leg, and a second bracket having a second base portion terminating at a third leg and a fourth leg.

The keyholes and legs provide a reversible locking mechanism wherein the first leg is adapted to engage the first keyhole, the second leg is adapted to engage the second keyhole, the third leg is adapted to engage the third keyhole and the fourth leg is adapted to engage the fourth keyhole. Each keyhole is preferably a hollow cylindrical tube.

The first bracket can be identical to the second bracket so that the two are interchangeable, i.e. the first bracket can be readily substituted for the second bracket and visa versa. Each of the keyholes provides an adjustable cylindrical tube for each corresponding leg so that they, in turn, provide adjustments to the overall width of the shelf for mounting into pre-existing structures of varying width.

The shelf is preferably constructed of steel wire, with the steel electro-plated with chrome. The shelf can also be constructed from other metal alloys, metals, synthetic composites, plastics, elastomers, polymers or copolymers. The steel wire, other metals and alloys can all be electroplated with stainless steel, chrome and the like. The constructed shelf can also be coated with epoxy, varnish, polyethylene plastics or the like. If the structure is made of a plastic, elastomeric or polymeric material, it can be injection molded.

BRIEF DESCRIPTION OF THE DRAWINGS

For a more complete understanding of this invention, reference is made to the following detailed description of the preferred embodiment in connection with the accompanying drawings.

DETAILED DESCRIPTION OF THE INVENTION

Figure 1:
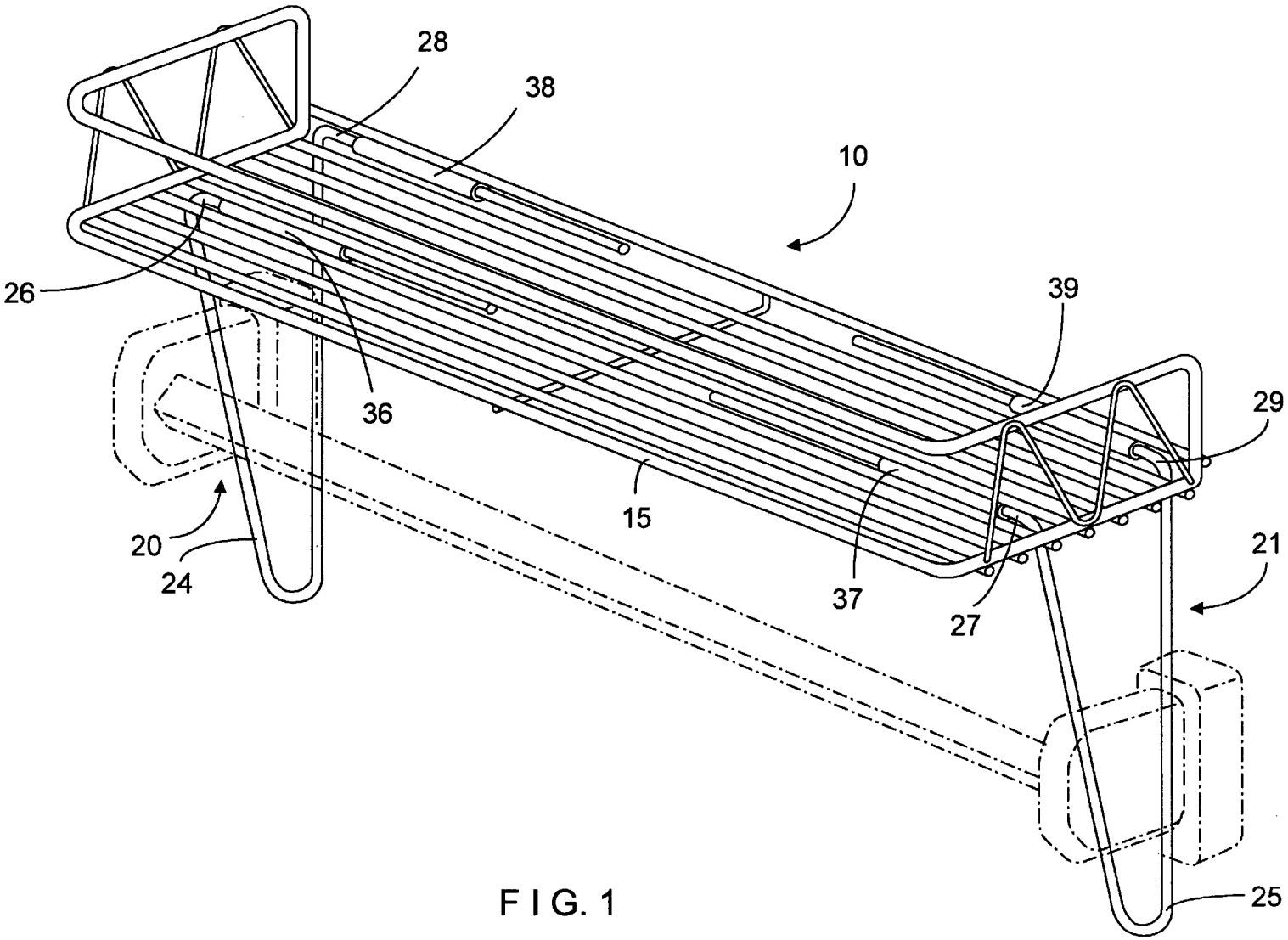
FIG. 1 is an upper perspective view of the collapsible rack shelf which depicts a suggested use for the present invention within a pre-existing towel rack drawn with phantom lines.

FIG. 1 illustrates the present invention showing an assembled shelf broadly designated with numeral 10. The embodiment shown is constructed principally of steel wire. Shelf 10 can be electro-plated with chrome or stainless steel using known electron-ion plating techniques, or coated with others material such as epoxy or polyethylene plastic. In addition to improving aesthetic appearance, plating and/or coating can enhance structural as well as physical qualities of shelf 10. For instance, plating will prevent corrosion of bear metal surfaces and an over coat of varnish will further reduce any possibility of oxidation.

One skilled in the art can also readily appreciate a variety of other possible materials suitable for the construction, plating and coating of shelf 10, especially after reviewing this disclosure. Shelf 10 does not have to be made of steel; other suitable metal alloys, substantially pure metals or even a synthetic composite of similar strength and ductility may be used for its construction. For example, shelf 10 can be constructed from other alloys of metals such as brass, a metal such as aluminum, or synthetic composites such as plastics, elastomers, polymers or copolymers. If the structure is made of a plastic, elastomeric or polymeric material, it is preferably injection molded.

Figure 3:
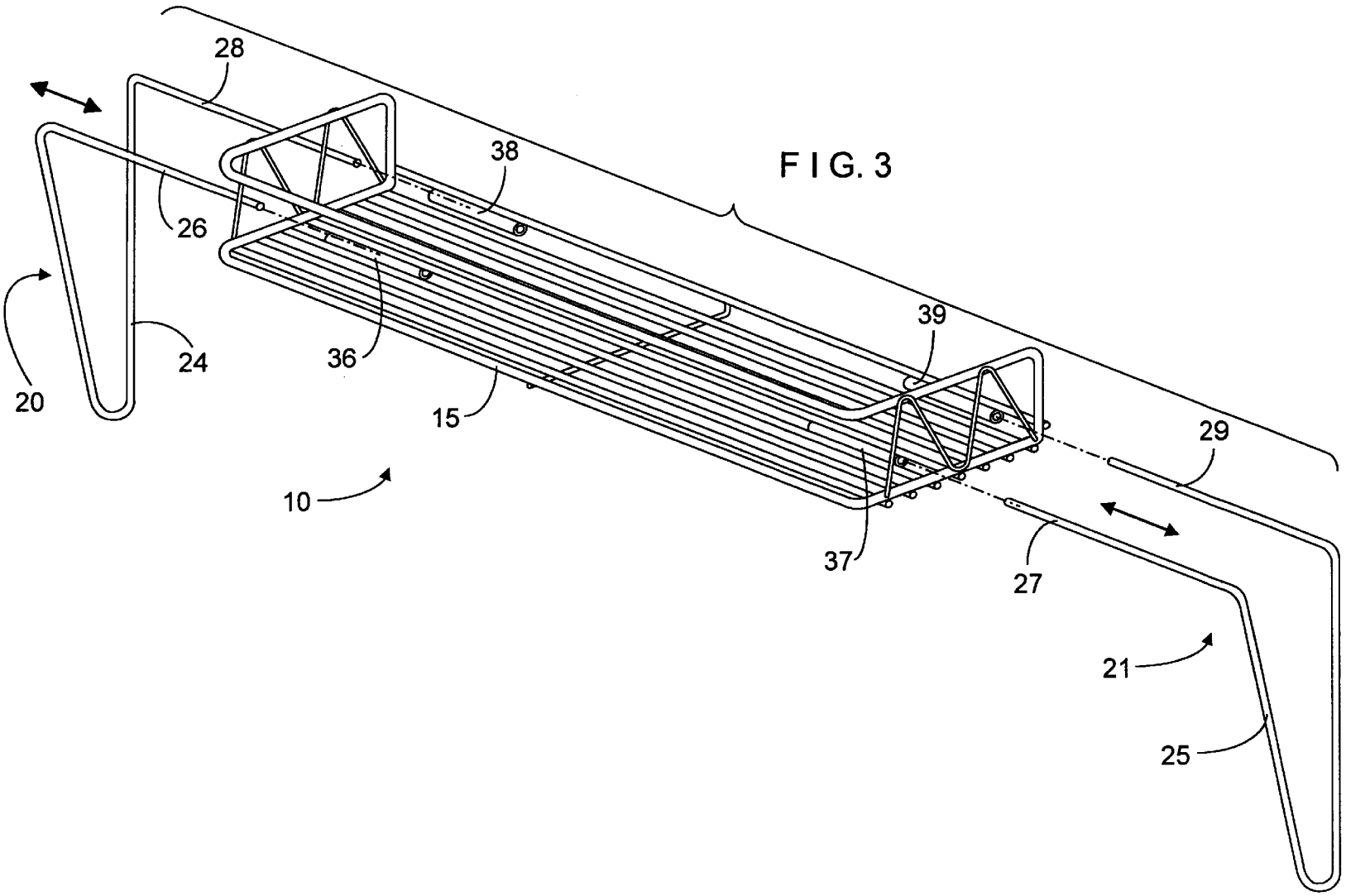
FIG. 3 is an exploded perspective view of the collapsible rack shelf showing its separate component pieces.

FIG. 3 shows that shelf 10 comprises three main pieces, namely, a central basket 15 and two matching brackets 20 and 21 which are insertable into basket 15 on either side through a reversible locking mechanism which is described in more detail below. Brackets 20 and 21 are each comprised of a V-shaped base 24 and 25, respectively. V-shaped base 24 terminates with bent legs 26 and 28, while V-shaped base 25 terminates with bent legs 27 and 29, as shown in FIG. 3.

Brackets 20 and 21 are preferably identical so that they can be interchanged to fit either ends of basket 15. Being identical reduces costs for its manufacture as another different component need not be made and its mirror image simplicity allows easy breakdown, packaging and re-assembly.

Referring back to FIG. 1, shelf 10 is shown situated within a conventional towel rack (drawn with phantom lines) as commonly found on a bathroom wall of a family home. As illustrated in FIG. 1, V-shaped bases 24 and 25 of brackets 20 and 21 are mountable into a conventional towel rack which creates an extra shelf. The extra shelf can be used for placing and holding various sundry items in neat order while taking advantage of the space immediately above the towel rack which is otherwise unused. As a practical design consideration, FIG. 1 shows that adequate space has to be left between the towel rack and the bottom of shelf 15 to provide adequate clearance for a towel.

It can also be appreciated by the skilled artisan that V-shaped bases 24 and 25 can be of different heights and that the shape of the bases are not limited to just a V-shape. All such variations are within the equivalent scope of this invention.

Figure 2:
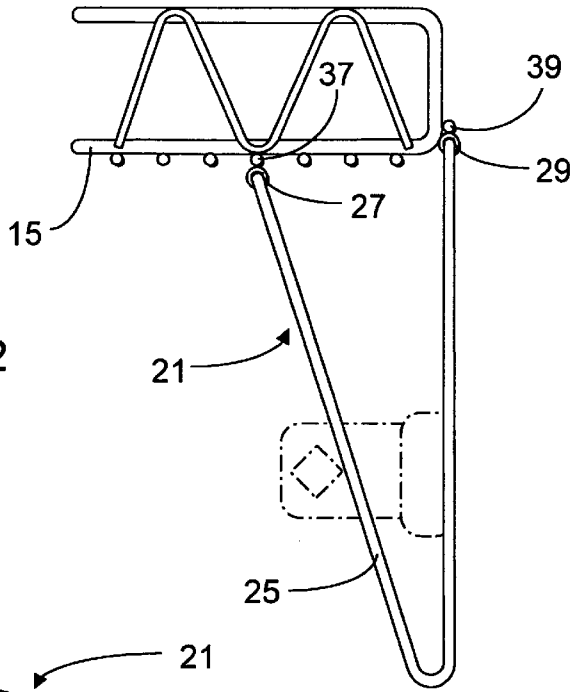
FIG. 2 is a side elevational view of the inventive rack shelf showing overall structural integrity provided by the preferred locking mechanism in place after assembly.

FIG. 2 is a side view of showing V-shaped base 25 of bracket 21 inserted into a conventional towel rack (illustrated in phantom lines). FIG. 2 also shows the overall structural integrity provided by the preferred locking mechanism. As the locking mechanism shown in FIG. 2 is a mirror-image of the corresponding locking mechanism on the opposite side, its description will be adequate for practicing both sets. Bracket 21 is identical to bracket 20 (not shown) so that the two are interchangeable, i.e. bracket 20 can just as readily be substituted for bracket 21 shown in FIG. 2. FIG. 2 also shows an end view of legs 27 and 29 of bracket 21 inserted into corresponding keyholes 37 and 39.

FIG. 3 depicts all components of the reversible locking mechanism of the embodiment shown therein. Legs 26 and 28 are shown adapted for insertion into corresponding keyholes 36 and 38, while legs 27 and 29 are shown adapted for insertion into corresponding keyholes 37 and 39, respectively. Each keyhole is depicted as a hollow cylindrical tube which forms a tunnel for receiving its corresponding leg. Equivalent variations to the cylindrical tube will be apparent to one skilled in the art. One leg and its corresponding keyhole can be considered a sub-unit of the overall locking mechanism.

In addition, FIG. 3 shows that the locking mechanism can provide adjustable overall width to shelf 10. Legs 26 and 28 are slidably adjustable within corresponding keyholes 36 and 38, and legs 27 and 29 are slidably adjustable within corresponding keyholes 37 and 39, respectively. Conventional towel racks, such as illustrated with phantom lines in FIG. 1, vary between 16.5 to 25 inches in overall width. The adjustable locking mechanism of the present invention provides a versatile extra shelf which can be retro-fitted into virtually any bathroom.

Figure 4:
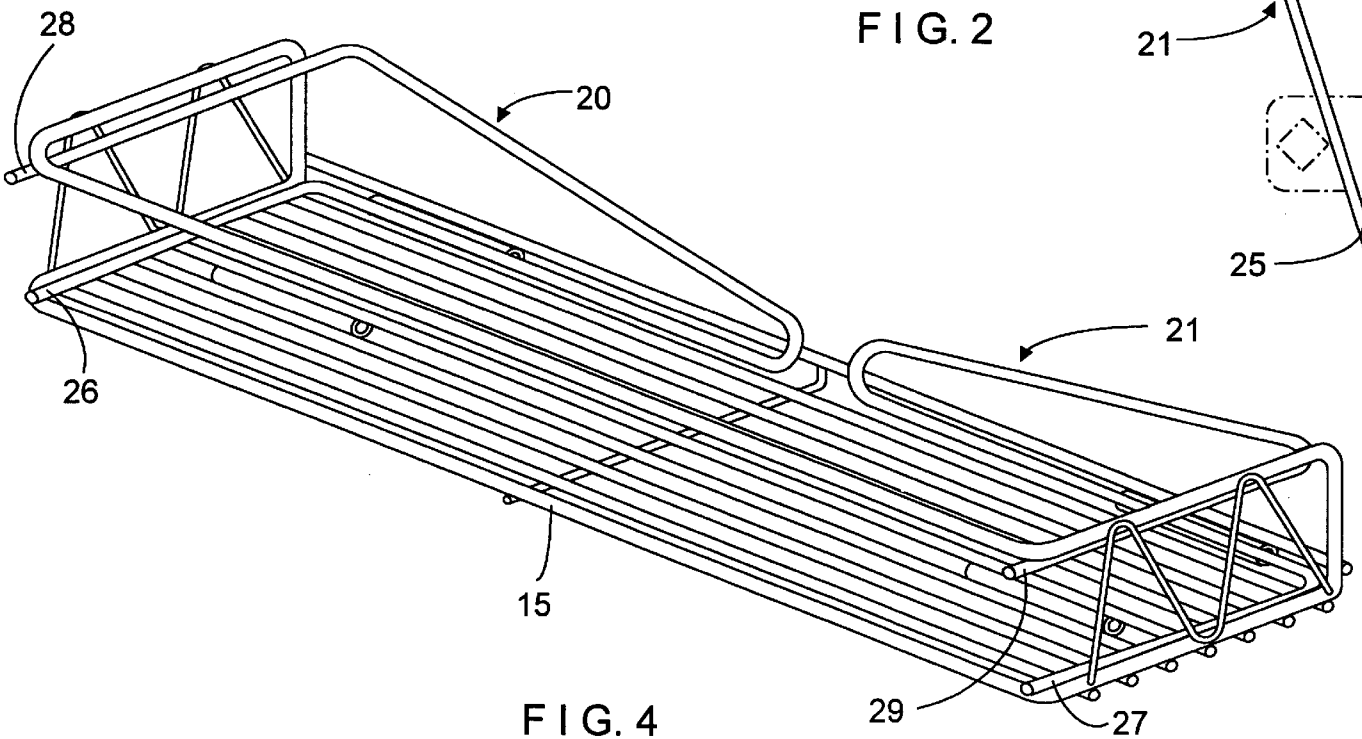
FIG. 4 shows the component pieces which make up the portable kit in optimum arrangement for shipping.

FIG. 4 shows the component pieces which make up the portable kit in optimum arrangement for shipping, of course, an end-user can just as readily arrive at the optimum, space-saving disassembled configuration for compact transport while traveling, for example, for use in a hotel room. The reversible nature of the locking mechanism is demonstrated by FIGS. 3 and 4. FIG. 3 shows that the smooth bore provided by keyhole 37, for instance, allows leg 27 to be inserted and withdrawn. When packed for shipping or travel as illustrated in FIG. 4, brackets 20 and 21 are placed within the confines of shelf 10 so that a compact, low profile and space-saving "brick" is formed. This configuration provides a shelf organizer which is collapsible for cost-effective shipping, storage and display for the vendor, and which is conveniently packed for the end-user traveller.

Figure 5:
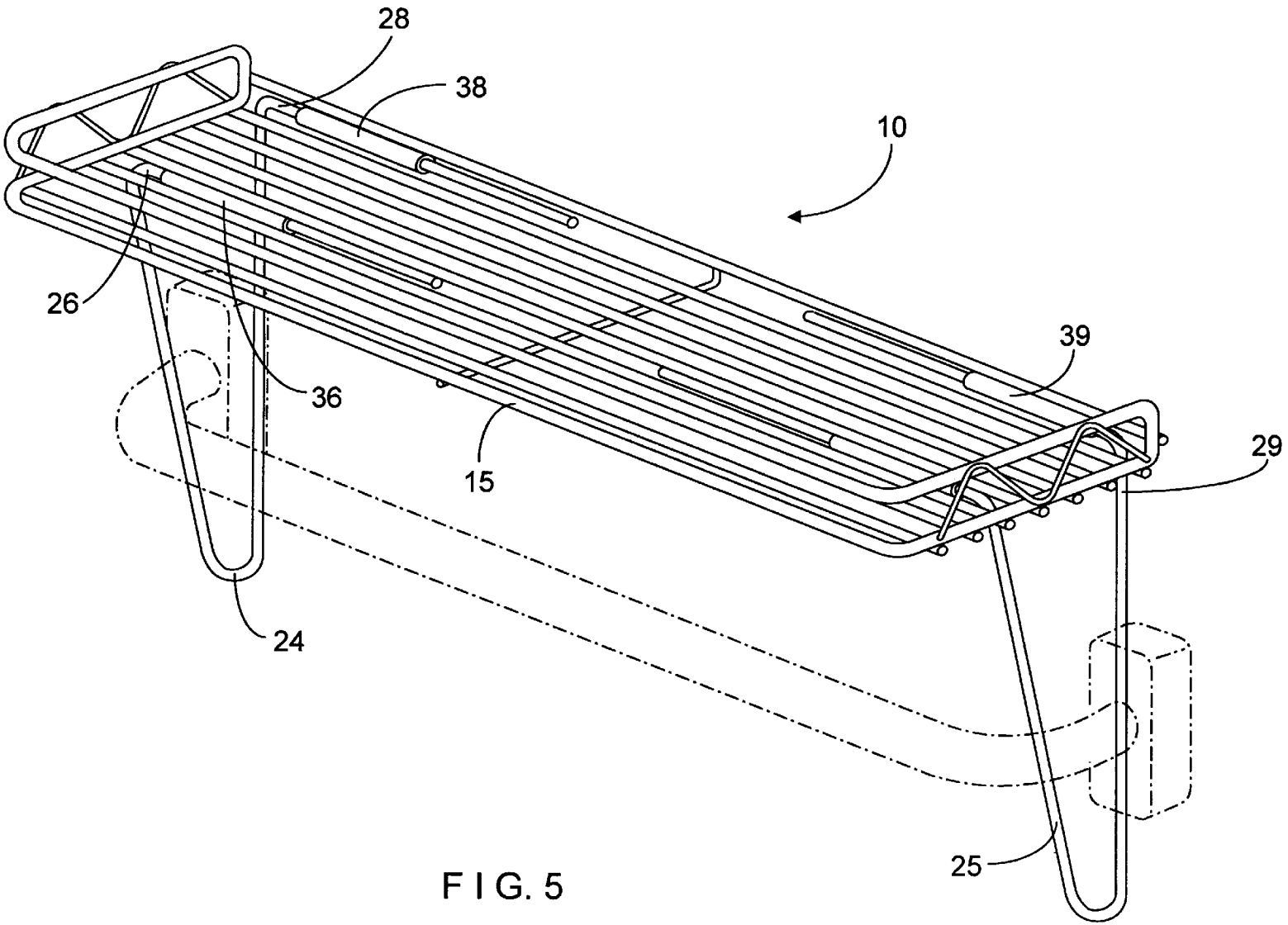
FIG. 5 shows a suggested use for the present invention in place within a pre-existing fixture rack depicted with phantom lines.

FIG. 5 shows another suggested use for the present invention in place within a pre-existing fixture rack depicted with phantom lines. Pre-existing fixtures contemplated by this disclosure include hand-rails for handicapped persons, general racks other than for towels, and the like.

The illustrated embodiments have proven to be useful in many applications for this art. Further modifications based on the disclosure will occur to persons skilled in the art. Such modifications are within the scope and spirit of the present invention as defined by the following claims.

What is claimed is:

1. A shelf of collapsible construction for mounting to a pre-existing structure attached to or fixedly adjacent a wall effective to provide a space between said pre-existing structure and said wall, said shelf comprising:

a central basket having a longitudinal axis having a first stationary keyhole, a second stationary keyhole, a third stationary keyhole and a fourth stationary keyhole;

a first bracket having a first base portion, said first base portion terminating at a first leg and a second leg, said first and second legs defining a first angle therebetween; and a second bracket having a second base portion, said second base portion terminating at a third leg and a fourth leg, said third and fourth legs defining a second angle therebetween, the longitudinal axis falls between respective first and second angles;

wherein said first leg is adapted to engage said first keyhole, said second leg is adapted to engage said second key-hole, said third leg is adapted to engage said third keyhole and said fourth leg is adapted to engage said fourth keyhole each leg engaging it's respective keyhole so as to be slidably engaged therein; and each of said first and second and third and fourth angularly related legs, respectively, being adapted to wedge in and support said shelf in said space between said pre-existing structure and said wall.

2. The shelf of claim 1 constructed of a material selected from the group consisting of a metal, a metal alloy and a synthetic composite.

3. The shelf of claim 2, wherein said metal alloy is steel.

4. The shelf of claim 2, wherein said synthetic composite is selected from the group consisting of a plastic, an elastomer, a polymer and a copolymer.

5. The shelf of claim 2, wherein said metal or metal alloy is electro-plated with a plating material selected from the group consisting of chrome and stainless steel.

6. The shelf of claim 2, wherein said material is coated with a composition selected from the group consisting of epoxy, varnish and polyethylene plastic.

7. The shelf of claim 1, wherein said first bracket is identical to said second bracket.

8. The shelf of claim 1, wherein each said keyhole is a cylindrical tube for adjustable insertion of each corresponding leg such that said adapted to engage action provides adjustments to the extent of said shelf between said first and second base portions for mounting to said pre-existing structure.

9. The shelf of claim 1, wherein each said keyhole is a hollow cylindrical tube.

10. The shelf of claim 1, wherein said pre-existing structure includes conventional towel racks or hand-rails.

* * * * *